United States Patent [19]

Takeuchi et al.

[11] 4,366,008

[45] Dec. 28, 1982

[54] METHOD FOR HARDENING STEEL

[75] Inventors: Jun Takeuchi; Kaishu Yamazumi; Takao Ishihara, all of Toyama, Japan

[73] Assignee: Kabushiki Kaisha Fujikoshi, Toyama, Japan

[21] Appl. No.: 246,049

[22] Filed: Mar. 20, 1981

Related U.S. Application Data

[63] Continuation-in-part of Ser. No. 119,673, Feb. 8, 1980, abandoned.

[30] Foreign Application Priority Data

Feb. 9, 1979 [JP] Japan ..... 54-14522
Dec. 11, 1979 [JP] Japan ..... 54-160573

[51] Int. Cl.[3] ..... C21D 1/18

[52] U.S. Cl. ..... 148/143; 148/12.4; 148/20.3

[58] Field of Search ..... 148/16.6, 16.5, 20.3, 148/12.4, 143, 144

[56] References Cited

U.S. PATENT DOCUMENTS

| | | | |
|---|---|---|---|
| 2,339,223 | 1/1944 | Holt | 148/16.5 |
| 3,137,596 | 6/1964 | Unterweiser | 148/16.6 |
| 3,265,541 | 8/1966 | Elias | 148/16.6 |
| 3,282,746 | 11/1966 | Zlotek | 148/16.6 |
| 3,357,869 | 12/1967 | Shepeljakousky | 148/16.6 |
| 3,647,572 | 3/1972 | Todd et al. | 148/16.6 |
| 3,705,058 | 12/1972 | Kolozsuari et al. | 148/16.6 |
| 4,047,981 | 9/1977 | Arnold et al. | 148/16.6 |
| 4,124,199 | 11/1978 | Jones et al. | 148/16.6 |
| 4,145,232 | 3/1979 | Solomon | 148/16.5 |

*Primary Examiner*—John P. Sheehan
*Attorney, Agent, or Firm*—Spencer & Kaye

[57] ABSTRACT

A method of hardening steel so that it may have a surface layer with sufficient hardness to permit fabrication into machinery parts with a minimum of strain developed therein. The method comprises heating steel at a temperature in a range not lower than 100° C. below its $A_1$ transformation point (about 630° C.) and not higher than 50° C. thereabove (about 780° C.) in an atmosphere consisting solely of ammonia gas, or composed of ammonia gas and at least one of organic liquids, petroleum gases, endothermic gases and neutral gases, while ammonia gas is being supplied continuously at a lower flow rate, or at a higher flow rate followed by a diffusion treatment to austenitize a surface layer of the steel by penetration of nitrogen thereinto, and quenching the steel to transform the austenitized surface layer into a martensite layer.

4 Claims, 25 Drawing Figures

HARDNESS HV
800
700
600
500
400
300
200
50
100
200
400
DISTANCE FROM THE SURFACE μ

HARDNESS HV
800
700
600
500
400
300
200
(W)
(Z)
(Y)
(X)
0
50
100
200
400
DISTANCE FROM THE SURFACE μ

HARDNESS HV
800
700
600
500
400
300
200
(Z)
(Y)
(X)
0
50
100
200
400
DISTANCE FROM THE SURFACE μ

HARDNESS HV
800
700
600
500
400
300
200
0
50
100
200
400
DISTANCE FROM THE SURFACE μ

HARDNESS HV
800
700
600
500
400
300
200
(Y)
(Z)
(W)
(X)
0
50
100
200
400
DISTANCE FROM THE SURFACE μ

METHOD FOR HARDENING STEEL

This is a continuation-in-part of our copending application Ser. No. 119,673 filed Feb. 8, 1980, abandoned.

BACKGROUND OF THE INVENTION

1. Field of the Invention

This invention relates to a novel method of hardening steel, and more particularly, to a hardening method which can provide machinery parts or the like with a sufficient hardness as required thereof to minimize the strain developed therein.

2. Description of the Prior Art

Various methods are known for hardening the surface layer of steel to prevent the development of strain therein. Induction hardening is applicable to only a limited range of steel materials, and not suitable for hardening materials having complicated shapes. Hardening by carburization requires only a relatively short time, since penetration of carbon is effected by heating at a higher temperature of, say, 800° C. to 950° C., than the $A_1$ transformation point. According to this method, however, it is difficult to obtain an accurate case depth, particularly when a thin carburized layer is desired. The internal structure of the steel to be treated undergoes transformation from austenite to martensite, and a sudden volumetric change takes place, so that strain develops to a significant extent. Another method known as nitriding, in which steel is treated at a lower temperature, i.e., 500° C. to 570° C., does not bring about any phase change in the steel, or any heavy strain therein. But as the hardness thereby obtained is attributed to the formation of a nitride and a diffusion layer, the surface treated by this method obtains only a thin hardened layer, and fails to have a sufficiently thick hardened layer. In order to increase the degree of hardening in the surface layer, it is necessary to add elements having a high affinity for nitrogen, for example, Al, W, Mo, Cr and V.

SUMMARY OF THE INVENTION

This invention has been achieved to provide a satisfactory solution to the aforementioned problems, and relies on the penetration of nitrogen into steel to lower its $A_1$ transformation point, and the penetration of nitrogen into hypoeutectoid steel having an austenitic structure and the quenching thereof to form a hardened martensitic surface layer, as opposed to the known nitriding method. As nitrogen penetrates into the surface layer of steel heated in a temperature range below the $A_1$ transformation point thereof, but not lower than 100° C. therebelow, the $A_1$ transformation point of the surface layer gradually drops until it becomes lower than the heating temperature, so that at the heating temperature, the structure of the surface layer changes from ferritic to austenitic, while the internal structure remains ferritic. Then, quenching causes martensitic transformation in the surface layer, so that only the surface layer is hardened, while no phase change takes place in the internal layer. If a hypoeutectoid steel is heated at a temperature above its $A_1$ transformation point, but not higher than 50° C. thereabove, the steel obtains a mixed austenitic and ferritic structure. If nitrogen is penetrated into the surface of the steel, its $A_1$ transformation point drops with the progress of nitrogen penetration, and the mixed austenic and ferritic phase in the surface layer turns austenitic, while the interior maintains the mixed austenitic and ferritic phase. If the steel having such a structure is quenched, the surface layer undergoes martensitic transformation, and is fully hardened, while the ferritic portion of the internal mixed austenitic and ferritic phase makes no change at all, but its austenitic portion transforms itself into a martensitic, troostitic, sorbitic, or other structure, and obtains a somewhat increased hardness. If a steel having a large quantity of nitrogen penetrated therein is quenched from a temperature in the vicinity of its $A_1$ transformation point, however, it obtains a structure having an outermost surface layer composed of a nitride (A), followed by a retained austenite layer (B), a martensite layer (C) and a matrix (D), as shown in FIG. 1. FIG. 1 shows the structure of a steel designated as S45C under Japanese Industrial Standard (JIS), which is equivalent to AISI 1045 or 1046 according to the designation of the American Iron and Steel Institute, heated at 710° C. for two hours in an atmosphere composed by supplying 15 liters of ammonia gas per minute and 10 cc of methanol per minute (partial pressure of ammonia gas: 0.72) and oil quenched. As is well known to those skilled in the art, partial pressure of ammonia gas is defined as a rate of flow of the supplied ammonia gas relative to the flow of the total supplied gas including the supplied ammonia gas plus supplied additives in the form of gas.

$$\text{Partial pressure of ammonia gas} = \frac{\text{flow of } NH_3 \text{ gas (1/hr.)}}{\text{flow of } NH_3 \text{ gas (1/hr)} + \text{additive gas (1/hr)}}$$

And when additive is in the form of liquid, (for example alcohol etc.), it can be calculated from the following formula.

1 gram. mole liquid = 22.4 liter gas.

The steel so treated failed to obtain a sufficiently high hardness in or around its surface layer, and indicates that the method employed is not suitable for the surface treatment of machinery parts or the like.

It is, therefore, an object of this invention to provide a novel and improved surface hardening method which can improve any such soft nitride and retained martensite layers, and form a martensitic structure in a hardened surface layer by controlling appropriately the heat treating atmosphere, temperature, and supply of ammonia gas.

The aforementioned object can be attained by the improved steel hardening method of this invention which comprises heating a steel in a temperature range not lower than 100° C. below its $A_1$ transformation point (about 630° C.) and not higher than 50° C. above the $A_1$ transformation point (about 780° C.) in an atmosphere consisting solely of ammonia gas supplied continuously at a flow rate of from about 0.1 to 2 furnace volume per hour, or at a flow rate of from about 2.1 to 7.5 furnace volume per hour followed by discontinuing the supply of ammonia gas and heating at the same temperature for about half an hour to one hour for diffusion treatment, thereby causing nitrogen to penetrate into the surface of the steel to austenitize its surface layer, and quenching it to transform the austenitic surface layer into a martensitic layer. Preferably, a mixture of ammonia gas, and one or more substances selected from the groups (a) to (d) may be used instead of the atmosphere consisting solely of ammonia gas, the groups (a) to (d) being as follows:

(a) Petroleum gas, such as propane and butane;
(b) endothermic gas generated by reforming petroleum gas;
(c) carburizing or reducing gas or liquid, including organic liquids, such as alcohols, esters and ketones; and
(d) neutral gas, such as nitrogen and argon.

The addition of such organic liquids, petroleum gas, endothermic gas or neutral gas leads advantageously to reduction in the partial pressure of ammonia gas, dilution of the atmosphere to prevent excess nitriding, and formation of a reducing atmosphere.

The supply of ammonia gas is preferably controlled in such a manner that ammonia gas is continuously supplied at a low partial pressure of from about 0.05 to 0.3 during heating over a predetermined length of time, followed by quenching, or if ammonia gas having a high partial pressure of from about 0.31 to 0.95 is employed, the supply of ammonia gas is interrupted halfway and heating is continued thereafter for diffusion of nitrogen, followed by quenching. The treatment conducted by continuing heating after interruption of the ammonia gas supply will hereinafter be called diffusion treatment.

These and other objects and advantages of this invention will become more apparent from the following description taken with reference to the accompanying drawings.

It will be noted that in the following description of the embodiments as well as prior art examples, all data was taken using an experimental furnace of a volume of 0.2 $m^3$ (200 liter). The partial pressure of ammonia gas (hereinafter referred to as "PPAG") is the partial pressure at the furnace entrance and in the form of a gas which is a mixture of ammonia gas and one or more additional gases.

Therefore "furnace volume per hour" is calculated from the following formula.

$$\text{Furnace volume per hour} = \frac{\text{supplied } NH_3 \text{ Gas volume per hour}}{\text{Furnace volume (200l)}}.$$

DESCRIPTION OF THE PREFERRED EMBODIMENTS

Figure 2:
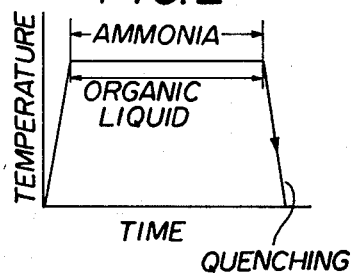
FIGS. 2 and 3 are graphs illustrating the heating cycles for the hardening method of this invention.
Figure 3:
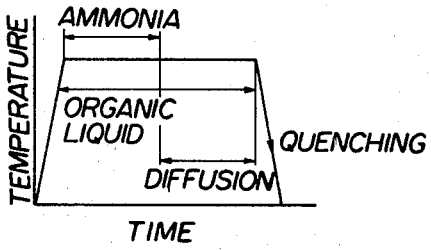

Referring to FIGS. 2 and 3 of the drawings showing heating curves by way of example, FIG. 2 illustrates a method of heating the material in the aforementioned temperature range for an appropriate length of time in an atmosphere consisting solely of ammonia gas, or further containing an organic liquid, followed by quenching, while FIG. 3 represents a hardening method in which, after the material is heated in the aforementioned temperature range for an appropriate length of time in an atmosphere consisting solely of ammonia gas, or further containing an organic liquid, the supply of ammonia gas is dicontinued, but heating is continued for diffusion purposes, followed by quenching.

Figure 4:
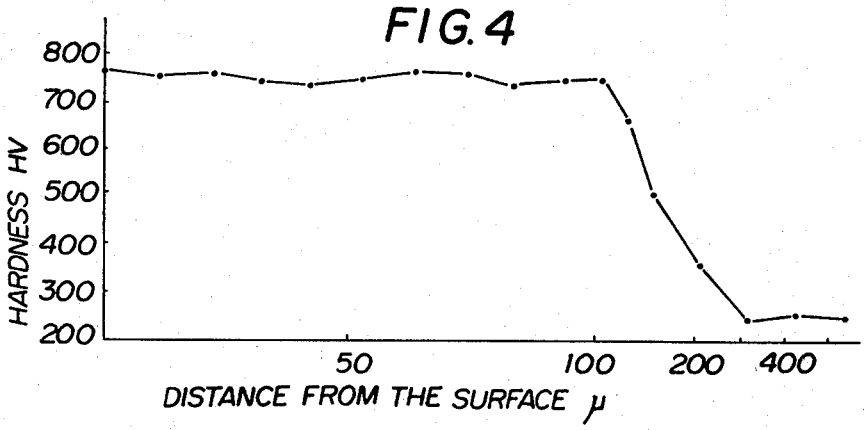
FIGS. 4, 5, 6(Y), 8(Y), 9, 10, 11, 20 and 21 each depict a hardness distribution curve taken in the vicinity of the surface of the material treated according to different preferred embodiments of the method of this invention.

FIG. 4 shows a hardness distribution curve for the S45C steel (equivalent to AISI 1045 or 1046) heated at 700° C. for two hours in an atmosphere consisting of ammonia gas and methanol supplied at the rate of 0.9 liter/min. and 10 cc/min., respectively (PPAG: 0.13), and quenched in oil immediately thereafter. It will be observed that the material shows a substantially uniform hardness up to a depth of about 0.1 mm under its surface.

Figure 5:
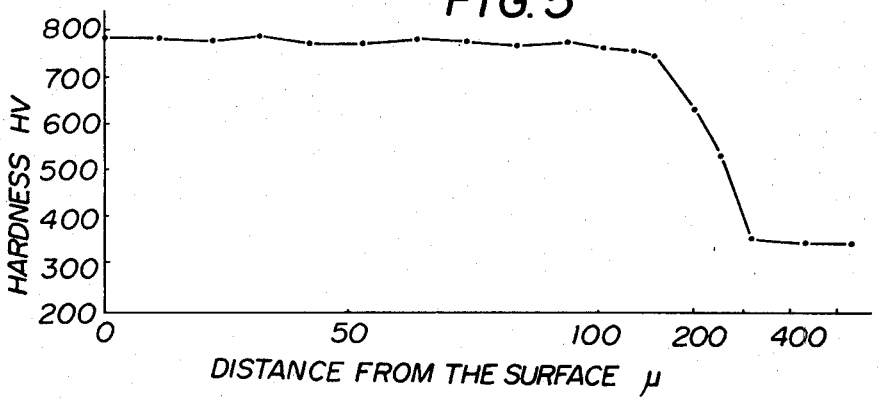

FIG. 5 shows a hardness distribution curve for the S45C steel heated at 750° C. for two hours in an atmosphere consisting of ammonia gas and methanol supplied at the rate of 0.9 liter/min. and 10 cc/min., respectively, and quenched in oil immediately thereafter. It will be noted that the material shows a higher degree of interior hardness than that heated at 700° C. as shown in FIG. 4.

Figure 1:
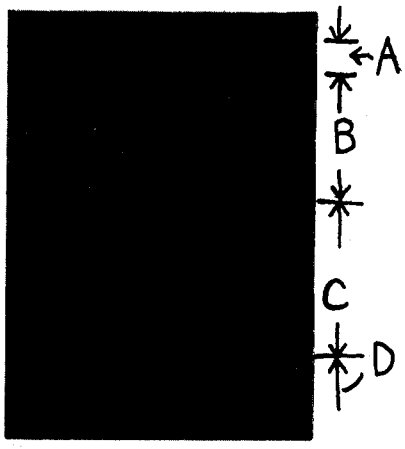
FIG. 1 is a microphotograph showing the surface portion of a hardened material obtained during the process of completion of this invention.
Figure 7:
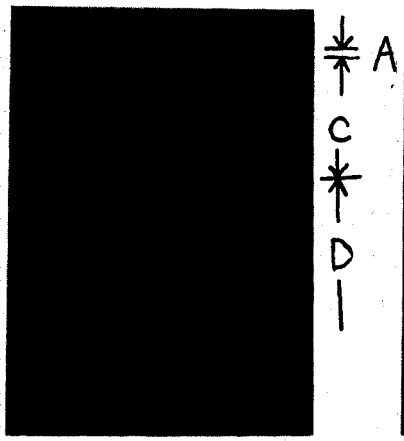
FIG. 7 is a microphotograph showing the structure of the hardened surface portion of the material shown at Y in FIG. 6.
Figure 6:
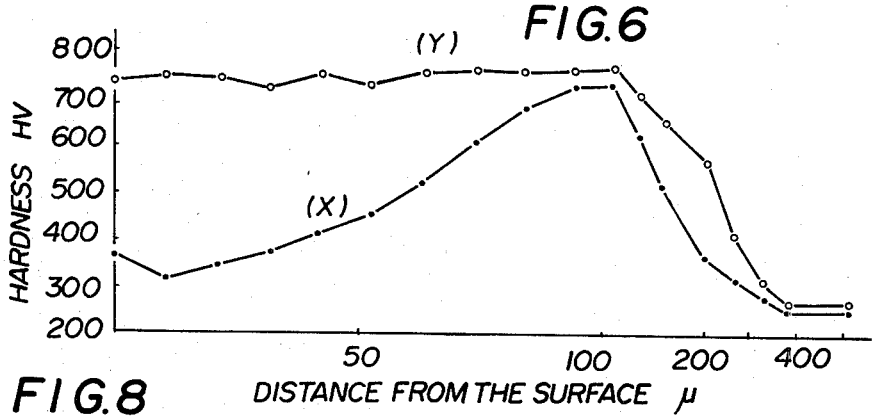

In FIG. 6, curve (X) represents the hardness distribution of the S45C steel heated at 700° C. for two hours in an atmosphere composed of ammonia gas and methanol supplied at the rate of 15 liters/min. and 10 cc/min., respectively, (PPAG: 0.72), and quenched in oil, while curve (Y) shows the hardness distribution of the S45C steel heated at 700° C. for one hour in a similar atmosphere, heated at the same temperature for one more hour after discontinuation of the atmosphere gas supply for diffusion purpose, and quenched in oil. Curve (Y)

indicates uniform hardening of the surface layer, while curve (X) shows that the material has not been properly hardened and is not an embodiment of this invention. FIG. 7 is a microphotograph showing the structure of the surface portion of the material represented by curve (Y) in FIG. 6. It has a very thin nitride layer (A) on the surface, followed by a martensite layer (C) and a matrix (D). It will be noted that in case such a high partial pressure of ammonia gas is employed, the diffusion treatment is useful for providing a satisfactory martensite layer.

Figure 8:
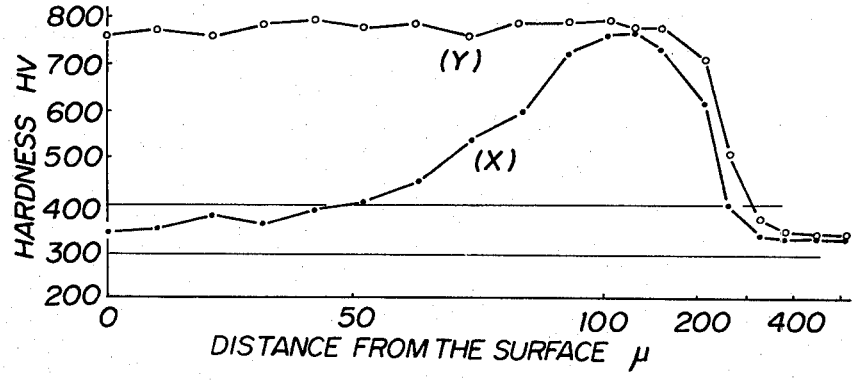

In FIG. 8, curves (X) and (Y) represent the hardness distributions of the materials treated under the same conditions as the materials (X) and (Y) shown in FIG. 6, except that the heating temperature was 750° C. Curve (X) refers to the material quenched in oil without any diffusion treatment and is not an embodiment of this invention, while curve (Y) refers to the material oil quenched after it was heated for diffusion purposes. Curves (X) and (Y) in FIG. 8 show exactly the same trends as those in FIG. 6, but indicate an increase in the hardened depth and the interior hardness.

Figure 9:
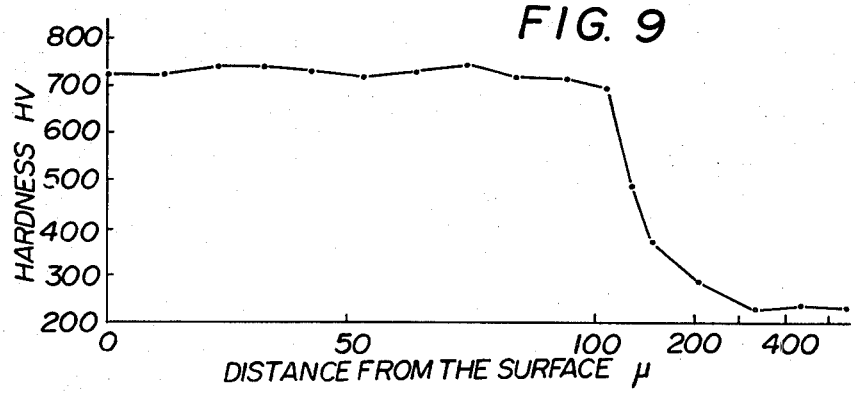

FIG. 9 shows the hardness distribution of the S45C steel heated at 700° C. for two hours in an atmosphere composed of ammonia gas and endothermic generated gas supplied at the rate of 0.9 liter/min. and 10 liters/min., respectively (PPAG: 0.082), and quenched in oil. It will be noted that the material has been formed with a layer of substantially uniform hardness up to a depth of about 0.1 mm under its surface.

Figure 10:
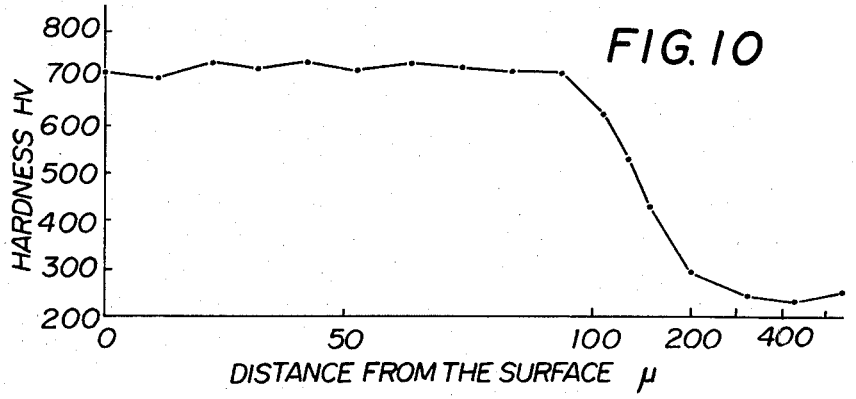

FIG. 10 shows a hardness distribution curve for the S45C steel heated at 700° C. for one hour in an atmosphere composed of ammonia gas and nitrogen supplied at the rate of 15 liters/min. and 10 liters/min., respectively (PPAG: 0.6), subjected to diffusion treatment at 700° C. for one hour, and quenched in oil.

Figure 11:
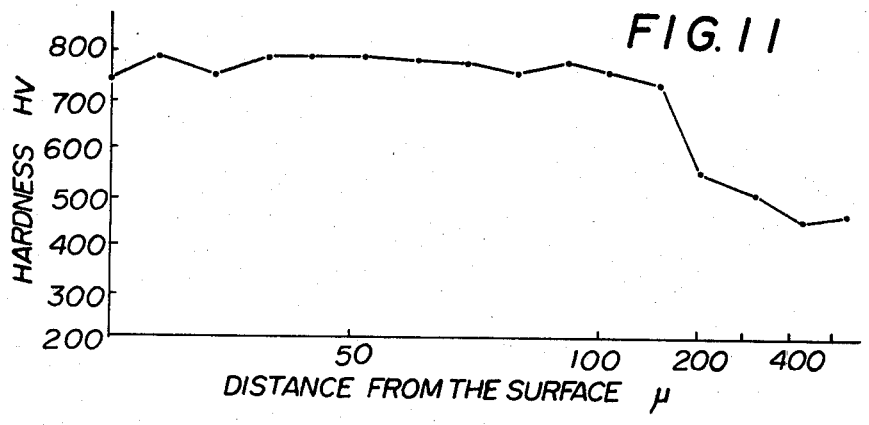

FIG. 11 shows the hardness distribution of the SNCM9 steel (by JIS, or equivalent to AISI 4347) heated at 720° C. for two hours in an atmosphere composed of ammonia gas and argon supplied at the rate of 1.5 liters/min. and 5 liters/min., respectively (PPAG: 0.23), and quenched in oil immediately thereafter. Each of the curves in FIGS. 10 and 11 indicates a sufficiently thick hardened surface layer.

Figure 12:
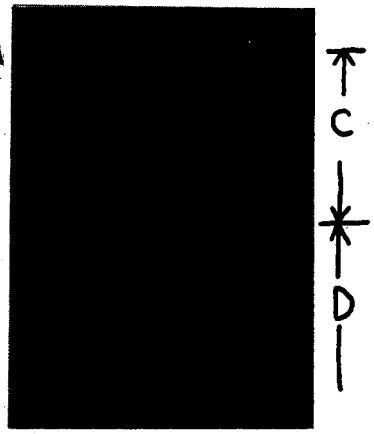
FIG. 12 is a microphotograph showing the structure of the surface portion of the material treated according to still another embodiment of the method of this invention.

FIG. 12 is a microphotograph showing the surface layer structure of the SNCM9 steel heated at 700° C. for one hour in an atmosphere composed of ammonia gas and methanol supplied at the rate of 15 liters/min. and 10 cc/min., respectively, subjected to diffusion treatment at 700° C. for one hour, and quenched in oil. The photograph shows an outermost surface layer of martensite (C), followed by a matrix (D).

Figure 13:
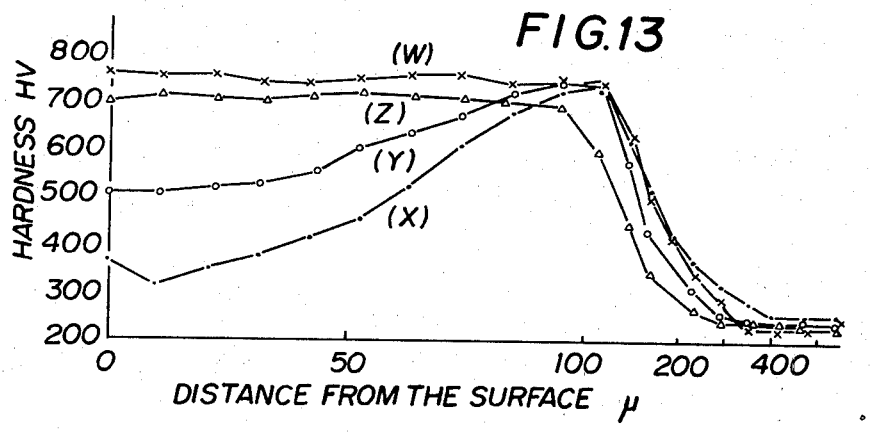
FIG. 13 shows curves representing the distribution of hardness in the vicinity of the surface of the materials treated by supplying ammonia gas at different rates.

FIG. 13 compares hardness distribution by varying the flow rate of ammonia gas. Every curve therein refers to the S45C steel heated at 700° C. for two hours, and quenched in oil, without any diffusion treatment. The atmosphere gas was composed of ammonia gas and methanol supplied at the rate of 15 liters/min. and 10 cc/min., respectively, for the treatment represented by curve (X), ammonia gas and methanol at 3 liters/min. and 10 cc/min. (PPAG: 0.34) for curve (Y), ammonia gas and methanol at 0.9 liter/min. and 10 cc/min. (PPAG: 0.13) for curve (Z), and ammonia gas at 0.9 liter/min. (0.27 furnace volume per hour) for curve (W). It will be observed that both of curves (X) and (Y) referring to the treatment at a high partial pressure of ammonia gas indicate failure to obtain a sufficiently hardened surface layer due to the retained austenite layer therein.

Figure 14:
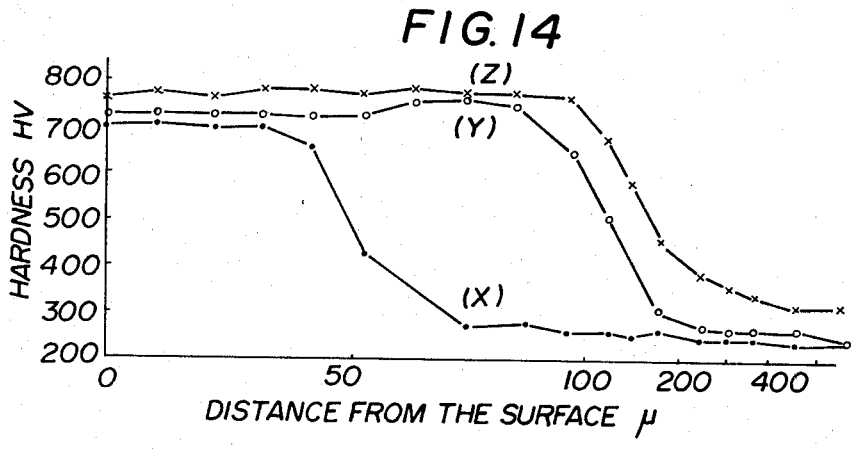
FIG. 14 compares the distribution of hardness in the vicinity of the surface of the materials treated according to the method of this invention by varying temperatures.

FIG. 14 compares hardness distribution for different heating temperatures. All the curves therein refer to the S45C steel heated for two hours in an atmosphere composed of ammonia gas and methanol at the rate of 0.9 liter/min. and 10 cc/min., respectively, and quenched in oil immediately without any diffusion treatment. The heating temperature was 680° C. for the treatment shown by curve (X), 710° C. for curve (Y), and 750° C. for curve (Z). As compared with curves (Y) and (Z), curve (X) indicates a thin hardened layer which is due to the low heating temperature delaying penetration of nitrogen, leading to slower reduction in the $A_1$ transformation point of the surface layer, thereby delaying the formation of an austenitic layer, hence a martensitic layer. Nevertheless, curve (X) indicates a deeper hardened layer than has been available by any known nitriding treatment, and as a further advantage, the minimum strain formation, since the low temperature involved avoids any phase change in the interior. On the other hand, the high temperatures involved in the treatment shown by curves (Y) and (Z) activate nitrogen penetration and facilitate austenitization, so that a large hardened depth can be obtained. As long as the heating temperature is in excess of the $A_1$ transformation point of the material to be treated, the presence of some phase change in the interior brings about an increased strain, but a higher degree of interior hardness can advantageously be obtained to improve the mechanical properties of the steel so treated.

Figure 15:
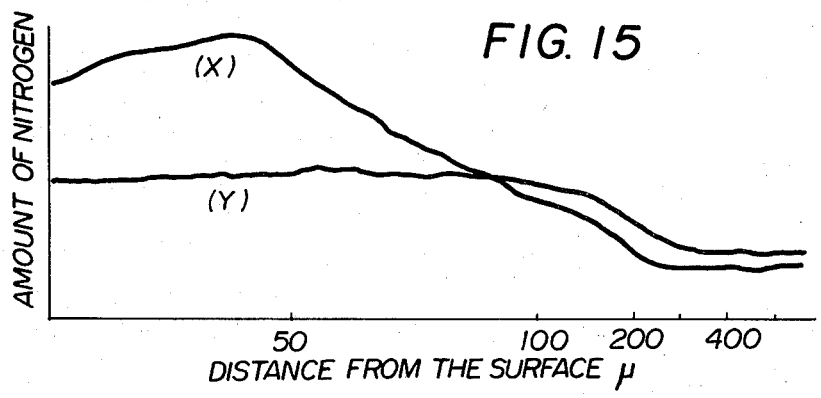
FIG. 15 shows the distribution of nitrogen concentration in the vicinity of the surface of the materials treated according to the embodiment of the method shown in FIG. 6.

FIG. 15 compares the distribution of nitrogen concentration in the surface layer of the material treated. Curve (X) refers to the S45C steel heated at 700° C. for two hours in an atmosphere composed of ammonia gas and methanol at the rate of 15 liters/min. and 10 cc/min., respectively, and quenched in oil, while curve (Y) refers to the same sort of material heated at 700° C. for one hour in the same atmosphere as described for curve (X), subjected to diffusion treatment at 700° C. for one hour, and quenched in oil. It is obvious that the diffusion treatment is useful for diffusing nitrogen and reducing its concentration.

A nitride layer is formed on the outermost surface of the material treated in an atmosphere containing a large quantity of ammonia gas, for example, with a partial pressure of ammonia gas of from about 0.31 to 0.95, or in an atmosphere containing solely ammonia gas being supplied at a flow rate of from about 2.1 to 7.5 furnace volumes per hour. The material so treated has a porous structure, and is not sufficiently hard. The structure of the surface layer can be improved by diffusion treatment. If ammonia gas is diluted until its partial pressure is from about 0.05 to 0.3, or ammonia gas is solely supplied at a flow rate of from about 0.1 to 2 furnace volume per hour, no diffusion treatment is required, but a hardened product having only a thin nitride layer and a satisfactory hardness distribution can be obtained.

The diffusion treatment is performed to diffuse nitrogen in the steel treated and reduce its concentration therein, since a large quantity of retained austenite is formed if steel is quenched from a temperature in the vicinity of its $A_1$ transformation point when it contains a large quantity of nitrogen therein. The diffusion of nitrogen makes it possible to form a fine martensitic structure by hardening austenitized steel.

Figure 20:
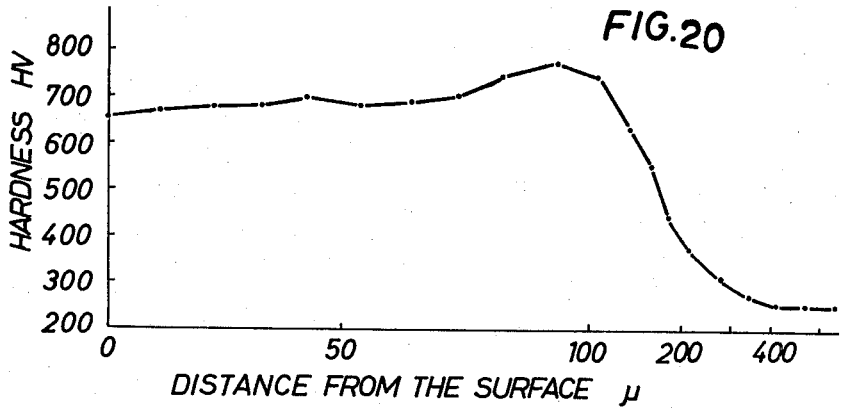

FIG. 20 shows a hardness distribution curve for the S45C steel heated at 710° C. for two hours in an atmosphere consisting solely of ammonia gas supplied at a rate of 5 liters/min. (1.5 furnace volumes per hour), and quenched in oil immediately thereafter. It will be observed that the metal shows a substantially uniform hardness up to a depth of about 0.1 mm under its surface, though not subjected to the diffusion treatment.

Figure 21:
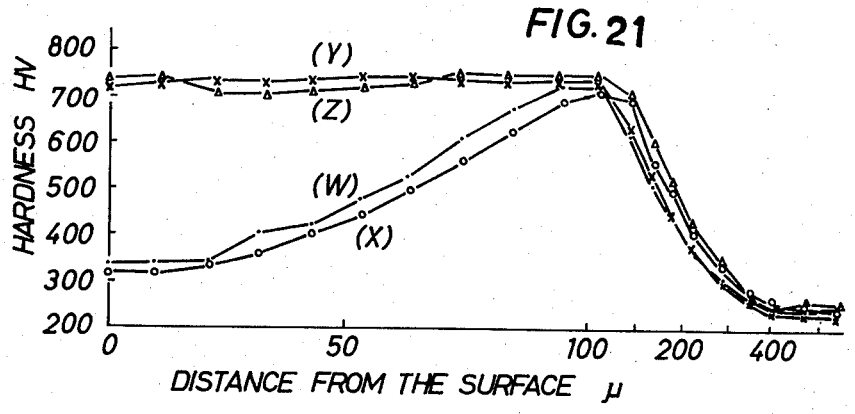

In FIG. 21, curve (W) represents the hardness distribution of the S45C steel heated at 710° C. for one hour in an atmosphere composed solely of ammonia gas supplied at the rate of 10 liters/min. (3.0 furnace volumes per hour), and quenched in oil, while curve (X) show the hardness distribution of the S45C steel treated under the same conditions as the material (W) in FIG. 21, except the ammonia gas is supplied at the rate of 20 liters/min. (6.0 furnace volumes per hour). Curve (Y) represents the hardness distribution of the S45C steel heated at 710° C. for one hour in an atmosphere composed solely of ammonia gas supplied at the rate of 10 liters/min., then subjected to the diffusion treatment of an atmosphere composed solely of nitrogen ($N_2$) gas supplied at the rate of 5 liters/min. under heating temperature of 710° C. for one hour, while curve (Z) shows the hardness distribution of S45C steel treated under the same condition as the material (Y) in FIG. 21, except the ammonia gas is supplied at the rate of 20 liters/min., instead of 10 liters/min. It will be noted that in case such a high flow rate of ammonia gas is solely employed, the diffusion treatment is useful for providing a satisfactory surface hardness.

Figure 16:
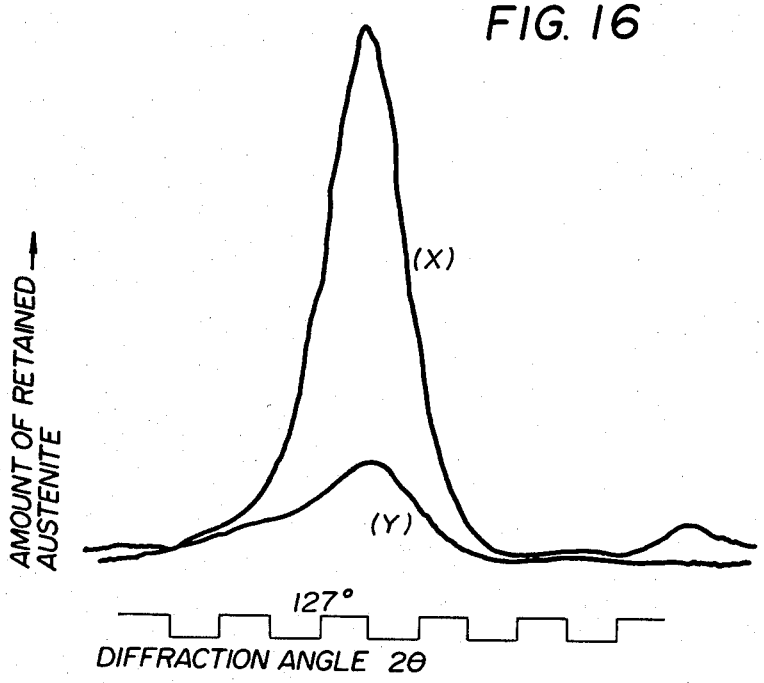
FIG. 16 shows the integrated strength distribution of the retained austenite in the surface of the material shown in FIG. 1, and the material treated in accordance with still another embodiment of this invention.
Figure 17:
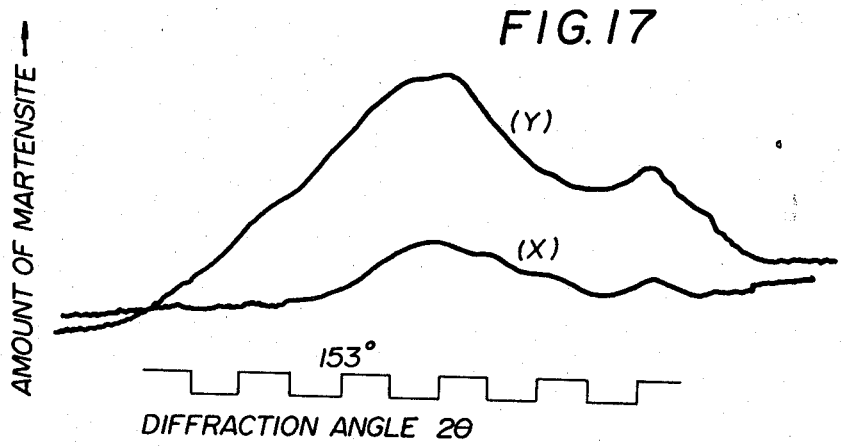
FIG. 17 shows the integrated strength distribution of the martensite in the surface portion of the materials shown in FIG. 16.

The curves in FIG. 16 represent integrated intensity distribution showing by X-ray diffraction changes of the quantity of retained austenite obtained by diffusion treatment. Curve (X) refers to the S45C steel heated at 710° C. for two hours in an atmosphere composed of ammonia gas and methanol at the rate of 15 liters/min. and 10 cc/min., respectively, and quenched in oil, while curve (Y) refers to the same sort of material heated at 710° C. for one hour in the same atmosphere as described for curve (X), subjected to diffusion treatment at 710° C. for one hour, and quenched. It will be noted that if no diffusion treatment is conducted, the retained austenite shows a very high integrated intensity, but is sharply reduced by diffusion treatment. Referring to FIG. 17, changes of the quantity of martensite are shown by curves representing integrated intensity distribution by X-ray diffraction. Curve (X) refers to the S45C steel heated at 710° C. for two hours in an atmosphere composed of ammonia gas and methanol at the rate of 15 liters/min. and 10 cc/min., respectively, and quenched in oil, while curve (Y) refers to the same sort of material heated at 710° C. for one hour in the same atmosphere as described for curve (X), subjected to diffusion treatment at 710° C. for one hour, and oil quenched. The curves indicate that while the martensite shows a very low integrated intensity if no diffusion treatment is performed, it is sharply increased by diffusion treatment. This clearly teaches that the changes in the quantity of martensite are closely related to those in the quantity of austenite shown in FIG. 16.

According to the hardening method of this invention, as hereinabove described, nitrogen is first caused to penetrate into the surface of steel at a working temperature in the vicinity of its $A_1$ transformation point. With the progress of nitrogen penetration, the $A_1$ transformation point of the surface layer of steel drops. Therefore, if the working temperature is lower than the $A_1$ transformation point, only the surface layer into which nitrogen has penetrated undergoes transformation from ferrite to austenite, and the interior structure of steel remains ferritic. If the material is then quenched, its surface layer undergoes martensitic transformation, and is hardened to provide a thick hardened layer which is comparable to that obtained by carburizing, while the interior of the material does not develop any appreciable strain, since no phase change takes place therein. If the working temperature is, on the other hand, higher than the $A_1$ transformation point, the penetration of nitrogen is facilitated, and the depth of a layer of austenitic transformation is increased, while a certain degree of phase change takes place in the interior of the material treated. If the material is then quenched, the austenite on the surface thereof is transformed into martensite, while the phase change in the interior increases the hardness thereof, and though some strain develops, it is far less than that caused by carburizing. The penetration of nitrogen is performed for lowering the $A_1$ transformation point of the steel to be treated, and not for forming a nitride for direct use for hardening purposes. Accordingly, the hardening method of this invention does not require that the steel to be treated contain an alloying element having a high affinity for nitrogen, as opposed to the known nitriding method.

Figure 18A:
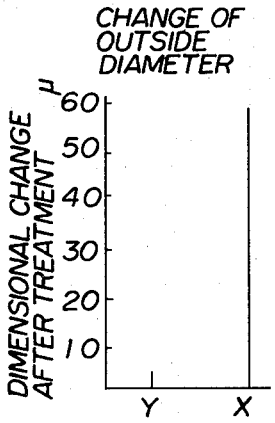
FIG. 18 compares the deformation of gears by hardening between the material treated according to this invention as shown at Y in FIG. 6, and the material carburized by a method known in the art, with respect to (a) variation in outside diameter, (b) variation in bore diameter, and (c) variation in span length of three teeth (displacement over three teeth)
Figure 18B:
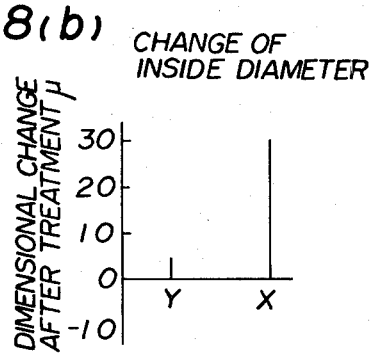
Figure 18C:
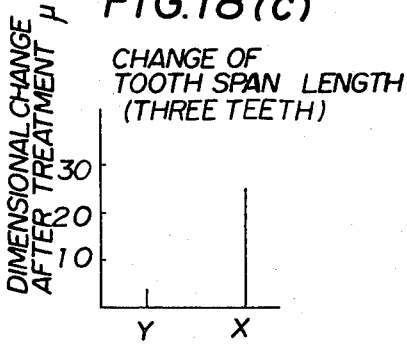

FIG. 18 compares deformation by hardening of gears made of S45C steel. Line (Y) refers to gears heated at 700° C. for one hour in an atmosphere composed of ammonia gas and methanol at the rate of 15 liters/min. and 10 cc/min., respectively, subjected to diffusion treatment at 700° C. for one hour, and oil quenched. Line (X) refers to the gears carburized at 920° C. for 100 minutes, heated at 850° C. for 30 minutes, and oil quenched, as known in the art. Each of the gears tested was a plain gear formed with 30 teeth, and having a module of 2.0, a pressure angle of 20° and a basic pitch circle diameter of 60 mm. FIG. 18 compares the variation in outside diameter at (a), variation in bore diameter at (b), and variation in the crossover tooth thickness for three teeth at (c). It will be observed that in all of the aspects compared, the gears treated in accordance with the method of this invention showed much less deformation than those treated by the known carburizing method.

Figure 19A:
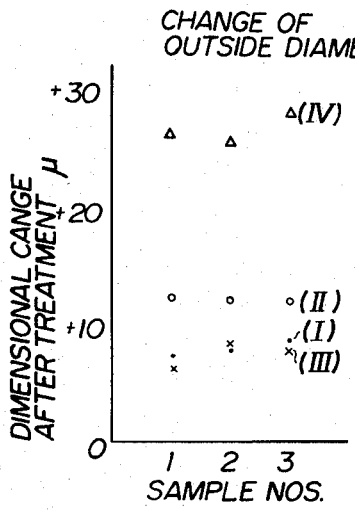
FIG. 19 compares the deformation of round bars by hardening between those treated according to methods embodying this invention, and those treated by known methods, with respect to (a) variation in outside diameter, (b) variation in length, and (c) maximum bending.
Figure 19B:
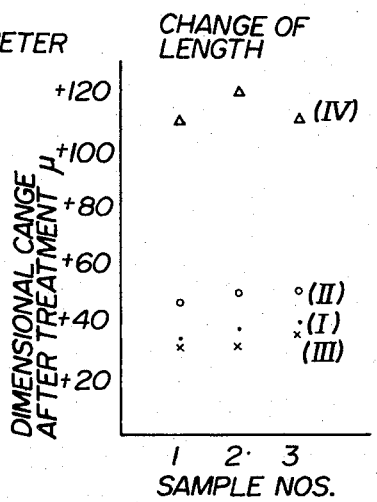
Figure 19C:
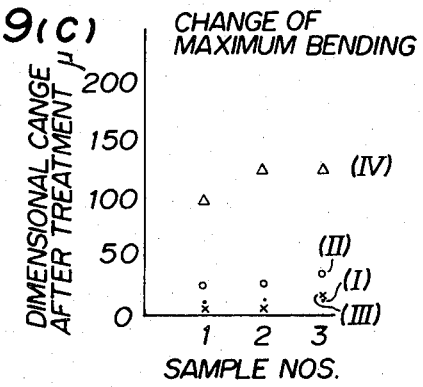

FIG. 19 compares deformation of round bars made of S45C steel, and measuring 15 mm in diameter and 100 mm in length. The dimensional changes shown at (I) refer to the bars heated at 700° C. for one hour in an atmosphere composed of ammonia gas and methanol at the rate of 15 liters/min. and 10 cc/min., respectively, subjected to diffusion treatment at 700° C. for one hour, and oil quenched, in accordance with the method of this invention, and those shown at (II) refer to the bars treated under the same conditions as described for (I), except that the temperature was raised to 750° C. The dimensional changes shown at (III) refer to the bars subjected to gas soft-nitriding at 570° C. for three hours in an atmosphere composed of ammonia gas and endothermic generated gas, and those shown at (IV) refer to the bars carburized at 920° C. for 100 minutes, heated at 850° C. for 30 minutes, and oil quenched, according to the known method. FIG. 19 compares the variation in the outside diameter of the bars at (a), variation in the length thereof at (b), and the maximum bending thereof at (c). In any of the aspects compared, the bars treated in accordance with the method of this invention showed much less deformation than those treated by the known carburizing method, though they showed substantially the same or a somewhat greater degree of deformation than those subjected to gas soft-nitriding treatment.

When steel is austenitized after its $A_1$ transformation point has been lowered by penetration of nitrogen, it retains a large quantity of austenite upon quenching, if a large quantity of nitrogen is present in the austenite, but if the nitrogen concentration in that region is controlled by diffusion treatment, the austenite is transformed into martensite, so that a satisfactory hardened structure can be obtained. If a dilute ammonia gas atmosphere, say, having a partial ammonia gas pressure of 0.13, is employed, martensitic transformation is accomplished upon quenching, even if no diffusion treatment is provided. Thus, the method of this invention can advantageously make it possible to form a sufficiently thick hardened surface layer having a sufficient hardness as required of machinery parts or the like, and a highly accurate case depth, while the transformation of the structure in the material treated is kept at a minimum, thereby minimizing the deformation of the material by hardening.

While the invention has hereinabove been described with reference to several preferred embodiments thereof, it is to be understood that further variations or modifications may be easily made by anybody of ordinary skill in the art without departing from the spirit and scope of this invention as defined by the appended claims.

What is claimed is:

1. A method of hardening steel, comprising:

heating the steel at a temperature in a range not lower than 100° C. below the $A_1$ transformation point of the steel (about 630° C.) and not higher than 50° C. above said transformation point (about 780° C.) in an atmosphere composed solely of ammonia gas being supplied at a flow rate of from about 0.1 to 2 furnace volume per hour to austenitize a surface layer of the steel by penetration of nitrogen thereinto, and quenching the steel to transform said austenitized surface layer into a martensite layer.

2. A method of hardening steel, comprising:

heating the steel at a temperature in a range not lower than 100° C. below the $A_1$ transformation point of the steel (about 630° C.) and not higher than 50° C. above said transformation point (about 780° C.) in an atmospere composed solely of ammonia gas being supplied at a flow rate of from about 2.1 to 7.5 furnace volume per hour to austenitize a surface layer of the steel by penetration of nitrogen thereinto, and discontinuing the supply of ammonia gas and heating at the same temperature for about half an hour to one hour for diffusion treatment, and quenching the steel to transform said austenitized surface layer into a martensite layer.

3. A method of hardening steel, comprising:

heating the steel at a temperature in a range not lower than 100° C. below the $A_1$ transformation point of the steel (about 630° C.) and not higher than 50° C. above said transformation point (about 780° C.) in an atmosphere composed of ammonia gas being supplied continuously at a partial pressure of from about 0.05 to 0.3, and at least one substance selected from the group consisting of (a) petroleum gas such as propane and butane, (b) endothermic gas generated by reforming petroleum gas, (c) a carburizing and reducing gas or liquid, including an organic liquid such as alcohols, esters and ketones, and (d) a neutral gas such as nitrogen and argon, to austenitize a surface layer of the steel by penetration of nitrogen thereinto, and quenching the steel to transform said austenitized surface layer into a martensite layer.

4. A method of hardening steel, comprising:

heating the steel at a temperature in a range not lower than 100° C. below the $A_1$ transformation point of the steel (about 630° C.) and not higher than 50° C. above said transformation point (about 780° C.) in an atmosphere composed of ammonia gas being supplied at a partial pressure of from about 0.31 to 0.95, and at least one substance selected from the group consisting of (a) petroleum gas such as propane and butane, (b) endothermic gas generated by reforming petroleum gas, (c) a carburizing and reducing gas or liquid, including an organic liquid such as alcohols, esters and ketones, and (d) a neutral gas such as nitrogen and argon, to austenitize a surface layer of the steel by penetration of nitrogen thereinto, and discontinuing the supply of ammonia gas and heating at the same temperature for about half an hour to one hour for diffusion treatment, and quenching the steel to transform said austenitized surface layer into a martensite layer.

* * * * *